US009633778B2

(12) United States Patent
Shen

(10) Patent No.: US 9,633,778 B2
(45) Date of Patent: Apr. 25, 2017

(54) MAGNETIC COMPONENT WITH BALANCED FLUX DISTRIBUTION

(71) Applicant: Hamilton Sundstrand Corporation, Charlotte, NC (US)

(72) Inventor: Miaosen Shen, Vernon, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 72 days.

(21) Appl. No.: 14/550,678

(22) Filed: Nov. 21, 2014

(65) Prior Publication Data

US 2016/0148748 A1 May 26, 2016

(51) Int. Cl.

| | |
|---|---|
| ***H01F 27/28*** | (2006.01) |
| ***H01F 3/10*** | (2006.01) |
| ***H01F 17/06*** | (2006.01) |
| ***H01F 27/24*** | (2006.01) |

(Continued)

(52) U.S. Cl.

CPC ..... *H01F 27/2895* (2013.01); *H01F 3/10* (2013.01); *H01F 17/062* (2013.01); *H01F 27/24* (2013.01); *H01F 27/28* (2013.01); *H01F 27/2823* (2013.01); *H01F 41/02* (2013.01); *H01F 41/0612* (2013.01); *H01F 2003/106* (2013.01)

(58) Field of Classification Search

CPC ..... H01F 27/00–27/36
USPC ..... 336/212, 233–234, 220–223, 229
See application file for complete search history.

(56) References Cited

U.S. PATENT DOCUMENTS 2,982,948 A * 5/1961 Brownlow ..... C04B 35/2625 307/422
3,170,133 A * 2/1965 Kernick ..... H01F 30/16 336/165

(Continued)

FOREIGN PATENT DOCUMENTS

DE 102012206225 A1 10/2013
JP 2005093962 A 4/2005

OTHER PUBLICATIONS

Extended European Search Report, for EP No. 15195587.9-1556, dated Apr. 7, 2016, 8 pages.

*Primary Examiner* — Tuyen Nguyen
(74) *Attorney, Agent, or Firm* — Kinney & Lange, P.A.

(57) ABSTRACT

An embodiment of an inductor assembly includes at least a first inductive loop with a first wire formed into a plurality of conductive windings around a first magnetic core section. The first magnetic core section includes at least a radially inner magnetic core portion with a first inner effective radius, $R_{in}(1)$, and a radially outer magnetic core portion with a first outer effective radius, $R_{out}(1)$. The radially inner magnetic core portion is formed from a first material having a first core maximum permeability value, $M_{max}(1)$. The radially outer magnetic core portion is formed from a second material having a first core minimum permeability value, $M_{min}(1)$, less than the first core maximum permeability value, $M_{max}(1)$. A single turn of each winding extends fully around both the first radially inner and outer core portions without passing between them.

16 Claims, 3 Drawing Sheets

(51) Int. Cl.
*H01F 41/02* (2006.01)
*H01F 41/06* (2016.01)

(56) References Cited

U.S. PATENT DOCUMENTS

| | | | | | |
|---|---|---|---|---|---|
| 3,339,163 | A | * | 8/1967 | Wentz | H01F 38/30<br>331/107 G |
| 3,454,916 | A | * | 7/1969 | Hoover | H01F 30/16<br>336/212 |
| 4,205,288 | A | * | 5/1980 | Lin | H01F 27/245<br>336/212 |
| 4,520,335 | A | | 5/1985 | Rauch et al. | |
| 4,565,746 | A | * | 1/1986 | Hayase | H01F 27/245<br>336/234 |
| 5,083,101 | A | * | 1/1992 | Frederick | H03H 1/0007<br>333/12 |
| 7,675,398 | B2 | * | 3/2010 | Endou | H01F 3/04<br>336/234 |
| 2012/0326820 | A1 | | 12/2012 | Yu et al. | |

* cited by examiner

MAGNETIC COMPONENT WITH BALANCED FLUX DISTRIBUTION

BACKGROUND

The present disclosure relates generally to electronic circuits, and more specifically to magnetic components for electronic circuits.

Magnetic components, such as inductor and transformer assemblies, use windings around a magnetic core to create magnetic flux inside the core. The resulting magnetic fields then regulate current flow and/or voltage in the circuit, either alone or in conjunction with other components. Core saturation and thermal limits often dictate the size and weight of the core. In traditional designs, it is often assumed that the flux is evenly distributed inside the core, making the cross-sectional area of the core an important design parameter. In reality, due to the dimension of the core, the flux tends to flow in a path with the least magnetic reluctance (similar to electrical resistance).

However, with conventional cores, reluctance is not uniformly distributed, which increases the likelihood of saturation in certain parts of the core and results in underutilization of the full volume of the cores. In a traditional inductor construction with a monolithic toroidal core, the flux is concentrated around the inner radius. Some simulations show the flux around the inner radius of a monolithic toroidal core with a large number of windings to be about 34 times the flux near the outer radius. This will result in saturation of the inner portion of the core before the outer portion of the core can be fully utilized.

SUMMARY

An embodiment of an inductor assembly includes at least a first inductive loop with a first wire formed into a plurality of conductive windings around a first magnetic core section. The first magnetic core section includes at least a radially inner magnetic core portion with a first inner effective radius, $R_{in}(1)$, and a radially outer magnetic core portion with a first outer effective radius, $R_{out}(1)$. The radially inner magnetic core portion is formed from a first material having a first core maximum permeability value, $M_{max}(1)$. The radially outer magnetic core portion is formed from a second material having a first core minimum permeability value, $M_{min}(1)$, less than the first core maximum permeability value, $M_{max}(1)$. A single turn of each winding extends fully around both the first radially inner and outer core portions without passing between them.

An embodiment of a method of making an inductor assembly includes building at least a first magnetic core section, and winding a first wire into a plurality of conductive windings to form a first inductive loop. The first magnetic core section includes at least a radially inner magnetic core portion with a first inner effective radius, $R_{in}(1)$, and a radially outer core portion with a first outer effective radius, $R_{out}(1)$. The radially inner magnetic core portion is formed from a first material having a first core maximum permeability value, $M_{max}(1)$, and the radially outer magnetic core portion is formed from a second material having a first core minimum permeability value, $M_{min}(1)$, less than the first core maximum permeability value, $M_{max}(1)$. A single turn of each winding extends fully around both the first radially inner and outer core portions without passing between them.

DETAILED DESCRIPTION

Conventional inductors have uneven flux distribution, causing the inner portion of the core to be saturated with flux, and leaving the outer portion of the core underutilized. As the following example embodiments show, having at least two discrete annular core portions (e.g., inner and outer cores) with different permeabilities, roughly proportional to their relative effective radii, allows a uniform winding arrangement and improved core utilization. This can simplify manufacture as to the complexity of windings, while still reducing size of the overall unit by maximizing flux distribution.

Figure 1:
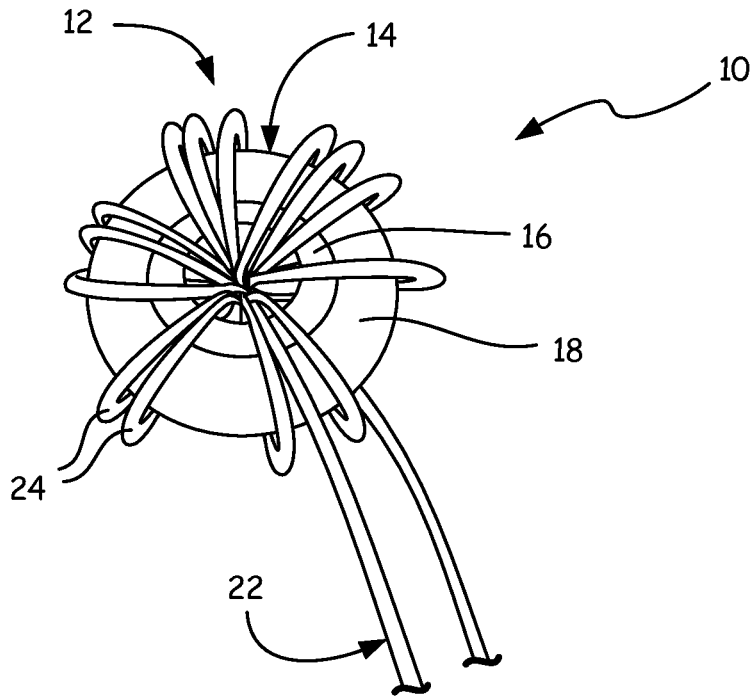
FIG. 1 is a perspective view of a first example embodiment of a toroidal inductor assembly.
Figure 2:
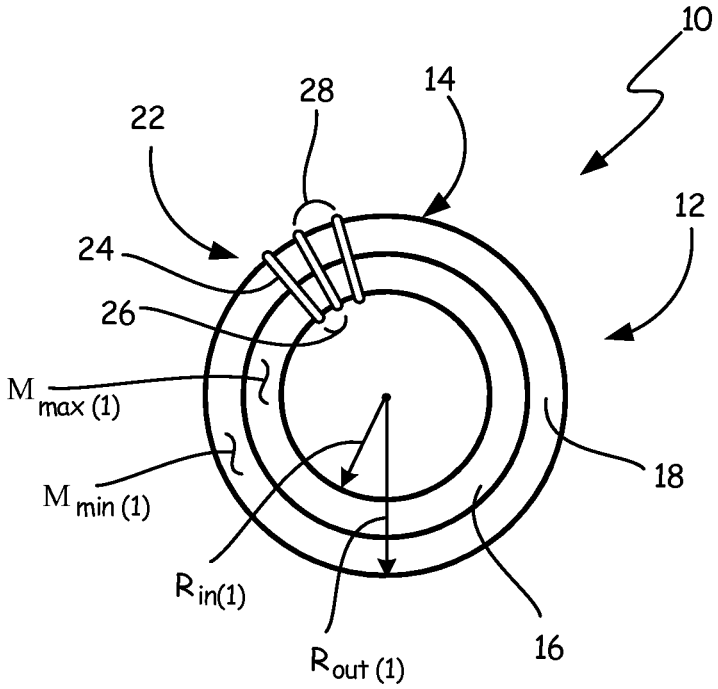
FIG. 2 is a top-facing view of the toroidal inductor assembly embodiment shown in FIG. 1.

FIG. 1 is a perspective view of a first example embodiment of a toroidal inductor assembly 10. In this embodiment, inductor assembly 10 has a single inductive loop 12, though in certain other embodiments, shown below, the inductor assembly can have multiple inductive loops in various orientations. FIG. 2 is a top view, better illustrating the different portions of magnetic core section 14.

First inductive loop 12 includes magnetic core section 14 having at least radially inner magnetic core portion 16 and radially outer magnetic core portion 18. With respect to first magnetic core section 14, inner core portion 16 has a first inner effective radius, $R_{in}(1)$, and outer core portion 18 has a first outer effective radius, $R_{out}(1)$. The inner and outer radii are each described as an "effective radius" because an inductor core need not be toroidal as is the case with FIGS. 1-3. As is known in the art, reluctance of a magnetic circuit is based in part on a ratio of the length of the circuit to its cross-sectional area. In other words, for a given circuit length, a toroidal inductive loop, with its circular cross-section, results in lower reluctance than a non-toroidal inductive loop. Thus in alternative embodiments with one or more non-toroidal cores (e.g., embodiments shown in FIGS. 4-6), the effective radius is used to approximate an inductive loop having a toroidal core of substantially equivalent size.

For magnetic core section 14, radially inner magnetic core portion 16 is formed from a first material having a first core maximum permeability value, $M_{max}(1)$, while radially outer core portion 18 is formed from a second material having a first core minimum permeability value, $M_{min}(1)$.

Wrapped around magnetic core section 14, first wire 22 is formed into a plurality of conductive windings 24 around first magnetic core section 14. A single turn of each winding 24 extends fully around both radially inner and outer core portions 16, 18 (of magnetic core section 14) without passing between them. Thus circumferential spacing between inner portions 26 of each winding 24 is much smaller than outer portions 28 of each winding 24. A number of windings 24 are omitted for purposes of clarity.

In a conventional inductor assembly with a monolithic inductor core, the permeability is substantially constant. Thus flux is generally concentrated around the inner portion of the core (e.g., where the radius is substantially smaller. At peak levels, this results in saturation of magnetic flux on the inner portion of the core, and underutilization about the outer portion of the core.

One previous attempt to solve the uneven flux issue utilized a two-piece core, but one with constant permeability in both pieces. The differing flux concentrations were dealt with through complex winding arrangement where multiple sets of windings are used, and only some of which pass over and around the inner core. This winding arrangement limited the types of geometries available and often increased production time and error rate.

Here, radially outer core portion 18 is formed from a second material having a which is less than the first core maximum permeability value, $M_{max}(1)$. Having a first magnetic core section 14 with maximum permeability value, $M_{max}(1)$, that is greater than minimum permeability value, $M_{min}(1)$, helps to balance the flux distribution in core section 14 resulting from the more conventional winding configuration.

To achieve more even flux distribution, and prevent premature core saturation, the respective permeability values can be selected to be generally and inversely proportional to the effective radius of each core portion. In this way, reluctance in inductive loop 12 remains relatively constant relative to radial position. Thus in certain embodiments, a relationship between the first core maximum and minimum permeability values, $M_{max}(1)$ and $M_{min}(1)$, and the first inner and outer effective radii, $R_{in}(1)$ and $R_{out}(1)$, is as shown in Equation 1.

$$0.90 \leq [M_{max}(1)/M_{min}(1)]*[(R_{in}(1)/R_{out}(1)] \leq 1.10 \quad (1)$$

In other words, in certain embodiments, to balance flux in magnetic core section 14, a ratio of maximum permeability value $M_{max}(1)$ to minimum permeability value $M_{min}(1)$ portion is within about ±10% of a ratio of the first inner and outer effective radii, $R_{in}(1)$ and $R_{out}(1)$.

Each core portion, including radially inner and outer core portions 16, 18 can be formed from a material in the desired permeability range, depending on the relative radial dimensions of each portion. Example material classes include ferrite, sintered iron powder, magnetic alloys, and wound tape. Each class of material has its own mechanical, thermal, and magnetic properties, and within each class, the particular composition and construction can be varied according to known processes to achieve a particularly desired core construction and resulting permeabilities under a particular set of operating or design parameters.

FIGS. 1 and 2 show one simple example embodiment with a single toroidal magnetic core having only radially inner core portion 16 abutting radially outer core portion 18. It will also be appreciated that the magnetic core section can also include at least one intermediate magnetic core portion disposed annularly between the inner and outer magnetic core portions.

Figure 3:
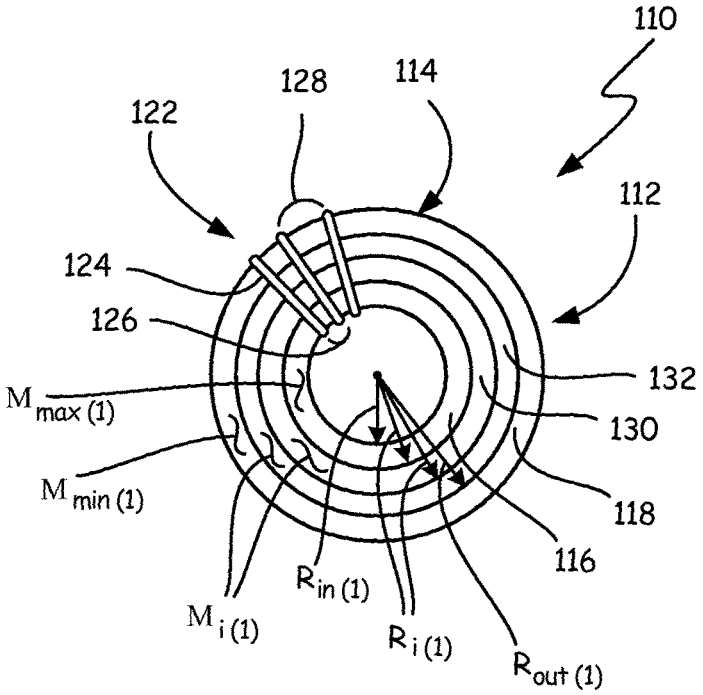
FIG. 3 is a top-facing view of a second example embodiment of a toroidal inductor assembly.

FIG. 3 shows a second embodiment, inductor assembly 110, where a single inductor loop 112 with magnetic core portion 114 has at least one intermediate magnetic core portion disposed annularly between radially inner core portion 116 and radially outer core portion 118. Similar to the first example embodiment shown in FIGS. 1 and 2, FIG. 3 also shows inductor assembly 110 with conductive wire 122 wrapped around magnetic core section 114 to form a plurality of conductive windings 124. A single turn of each winding 124 extends fully around both radially inner and outer core portions 116, 118, in addition to intermediate core portions 130, 132 without passing between any adjacent core portions. A number of windings 124 are omitted for purposes of clarity.

Each intermediate magnetic core portion (e.g., 130, 132 in FIG. 3) has a corresponding core intermediate permeability value, $M_i(1)$, between the first core maximum and minimum permeability values, $M_{max}(1)$ and $M_{min}(1)$. Thus, in addition to the relationship shown in Equation 1 above, the permeability values of the one or more intermediate core sections can meet the parameters shown in Equation 2.

$$M_{max}(1) \leq M_i(1) \leq M_{min}(1) \quad (2)$$

As noted, inductor assembly 110 can include plurality of first intermediate magnetic core portions disposed annularly between inner and outer magnetic core portions 116, 118. Each of the plurality of first intermediate magnetic core portions (130, 132, etc.) can have a corresponding first core intermediate permeability value, $M_i(1)$, so that each first core intermediate permeability value, $M_i(1)$ has a stepwise difference from an adjacent first core intermediate permeability value, $M_i(1)$. The plurality of first core intermediate permeability values, $M_i(1)$, therefore result in the first magnetic core section approaching a continuously variable permeability radially between the first inner and outer magnetic core portions.

In certain embodiments, magnetic core section 112 can also include a discrete air gap disposed annularly between the radially inner and outer magnetic core portions. Note that this may be in addition to a distributed air gap seen in certain sintered or wound core constructions. In such alternative embodiments, one or both of intermediate magnetic core portions 130, 132 are omitted and replaced by a plurality of spacers or similar dielectric elements to annularly space inner and outer magnetic core portions 116, 118 (as well as any remaining intermediate core portions). In these embodiments, it should be noted that single windings 124 still extend around both inner and outer core portions 118 and do not pass through the discrete air gap. This is to maintain the generally constant reluctance achievable through the different permeabilities tailored to a particular size core.

In certain of these embodiments, magnetic core section 114 can include a permeability that approaches continuous variability between inner and outer magnetic core portions 116, 118. The large plurality of intermediate core portions which include portions 130, 132, among others (not shown for clarity) can potentially be formed, e.g., after advances in additive manufacturing technology. The permeability of each intermediate core varies in a stepwise manner to maintain generally proportionality to its effective radius. This allows inductive loop 112 to have substantially constant reluctance regardless of radial position.

Figure 4:
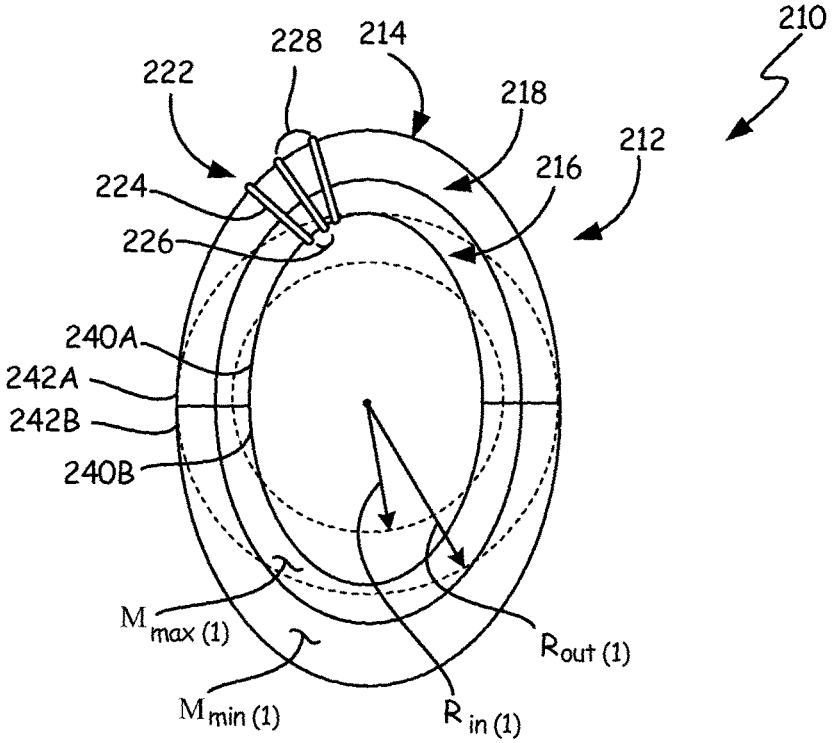
FIG. 4 is a top-facing view of a first example embodiment of a non-toroidal inductor assembly.

FIG. 4 shows yet another alternative embodiment. As noted above, the example embodiments in FIGS. 1-3 show toroidal cores but the present disclosure is not so limited. This time, FIG. 4 shows inductor assembly 210 has a single inductive loop 212, but with non-toroidal magnetic core section 214. Like previous examples, non-toroidal magnetic core section 214, shown here as an oval shape. Note that two C-core segments (e.g., those segments shown in FIG. 5) can be substituted to make a rectangular shape rather than the curved oval shape shown here. In either case, non-toroidal magnetic core section 214 includes inner and outer magnetic core portions 216, 218. In this instance, like the others, to achieve a first magnetic core section 214 inner magnetic core portion 216 is formed from a material so as to have maximum permeability value, $M_{max}(1)$, that is greater than minimum permeability value, $M_{min}(1)$, for outer magnetic core portion 218.

As in the previous examples, this relationship improves balance of flux distribution in core section 214 between the inner and outer portions of the core. To achieve more even flux distribution, the respective maximum and minimum permeability values $M_{max}(1)$ and $M_{min}(1)$ for core section 214, can be selected to be generally and inversely proportional to the effective radius of each core portion 216, 218. In this way, reluctance through core section 214 remains relatively constant regardless of the effective radial position. Thus in certain embodiments, a relationship between the first core maximum and minimum permeability values, $M_{max}(1)$ and $M_{min}(1)$, and the first inner and outer effective radii, $R_{in}(1)$ and $R_{out}(1)$, is similar to that referenced in Equation 1 above, and reproduced here.

$$0.90 \leq [M_{max}(1)/M_{min}(1)]*[(R_{in}(1)/R_{out}(1)] \leq 1.10 \quad (1)$$

Wrapped around magnetic core section 214, first wire 222 is formed into a plurality of conductive windings 224 around first magnetic core section 214. A single turn of each winding 224 extends fully around both radially inner and outer core portions 216, 218 (of magnetic core section 214) without passing between them. Thus circumferential spacing between inner portions 226 of each winding 224 is much smaller than outer portions 228 of each winding 224. A number of windings 224 are omitted for purposes of clarity.

Though a toroidal core provides more reluctance for a given length of the inductive loop, sometimes packaging, weight, and/or balance considerations will dictate a different non-toroidal shape. To achieve the non-toroidal shape of magnetic core section 214, a plurality of partial cores may be provided. Here, inner magnetic core portion 216 can be formed from two curved C-shape segments 240A, 240B, while outer magnetic core portion 218 can be formed from two curved C-shape segments 242A, 242B. To provide proper permeability, core segments 240A and 240B should have substantially the same permeability as each other, while core segments 242A and 242B should also have substantially the same permeability as each other, but different from core segments 240A and 240B.

Figure 5:
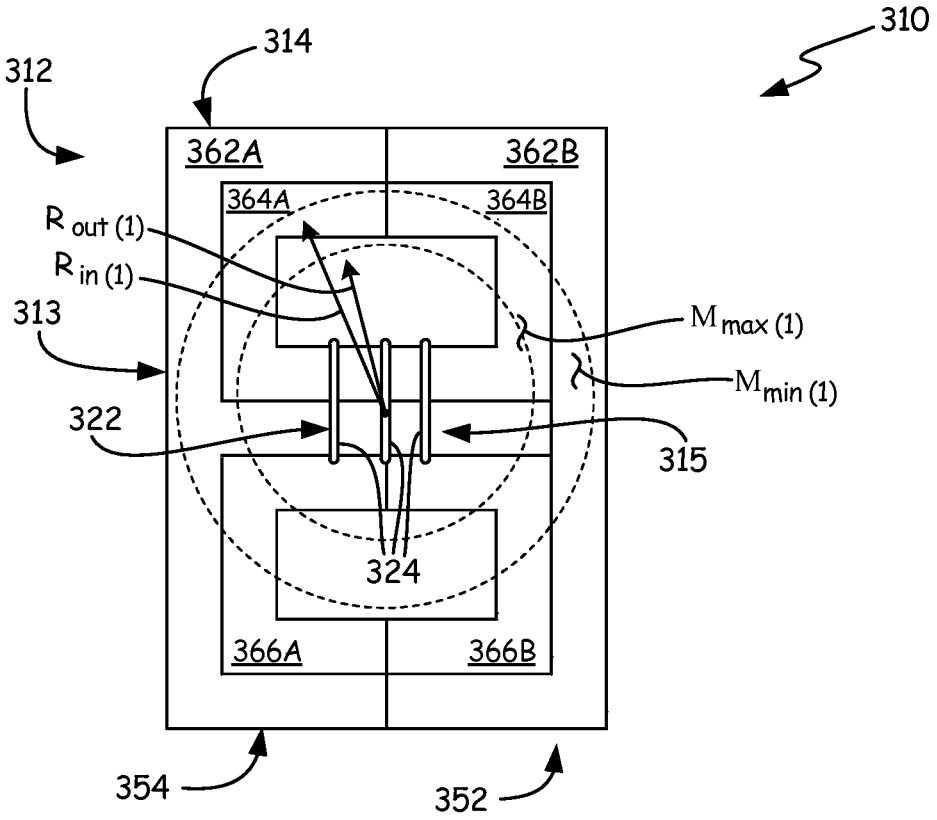
FIG. 5 is a top-facing view of a second example embodiment of a non-toroidal inductor assembly.

FIG. 5 shows inductor assembly 310 which includes first inductive loop 313. Similar to the previous examples having a single inductive loop, first inductive loop 313 includes central magnetic core section 315. For central magnetic core section 315, radially inner magnetic core portion 317 is formed from a first material having a first core maximum permeability value, $M_{max}(1)$, while radially outer core portion 319 is formed from a second material having a first core minimum permeability value, $M_{min}(1)$. First wire 322 is formed into a plurality of conductive windings 324 around central magnetic core section 315 to complete the magnetic circuit. As above, a single turn of each winding 324 extends fully around both radially inner and outer core portions 317, 319 without passing between them.

To balance the flux distribution in central core section 315, respective permeability values are again selected to be generally and inversely proportional to the effective radius of each core portion. In this way, reluctance through first inductive loop 313 remains relatively constant relative to radial position. In certain embodiments, a relationship between the first core maximum and minimum permeability values, $M_{max}(1)$ and $M_{min}(1)$, and the first inner and outer effective radii, $R_{in}(1)$ and $R_{out}(1)$, again can follow the relationship of Equation 1.

$$0.90 \leq [M_{max}(1)/M_{min}(1)]*[(R_{in}(1)/R_{out}(1)] \leq 1.10 \quad (1)$$

FIG. 5 shows one example core construction in which E-shaped core segments 362A, 362B combined with first and second pairs of C-shaped core segments 364A, 364B, and 366A, 366B. For this core configuration, the relative permeabilities of core segments 362A, 362B, 364A, 364B, 366A, and 366B would depend on the location of windings 324 as well as the number of winding sets. In turn, this determines the number and resulting location of inductive loops in assembly 310.

FIG. 5 shows a single inductive loop 313 in the center of assembly 310. Though C-shaped core segments are on the interior of assembly 310, relative to inductive loop 313, they actually form outer portion 319 of central magnetic core section 315. Middle legs of E-shaped segments 362A, 362B form inner magnetic core portion 317.

However, assembly 310 or other inductor constructions can be further adapted to include multiple inductive loops, one or more of which would have a similar relationship between permeabilities and effective radii to increase utilization of one or more cores (or core sections). For example, assembly 310 can be adapted to have two sets of windings so that an upper portion of the assembly (as depicted in FIG. 5) forms first inductive loop 312 with first magnetic core section 314, while a lower portion of assembly 310 forms second inductive loop 352 with second magnetic core section 354.

As in other embodiments, the permeability values for the second magnetic core section would generally be inversely proportional to effective radii of the radially inner and outer core portions. In certain embodiments, a relationship between the second core maximum and minimum permeability values, $M_{max}(2)$ and $M_{min}(2)$, and the second inner and outer effective radii, $R_{in}(2)$ and $R_{out}(2)$ would thus follow Equation 3.

$$0.90 \leq [M_{max}(2)/M_{min}(2)]*[(R_{in}(2)/R_{out}(2)] \leq 1.10 \quad (3)$$

The inductor assemblies of the preceding examples can be made according to related methods. In one example, a method of making an inductor assembly includes building a first magnetic core section including at least a radially inner magnetic core portion with a first inner effective radius, $R_{in}(1)$, and a radially outer core portion with a first outer effective radius, $R_{out}(1)$. A first wire can be wound into a plurality of conductive windings to form a first inductive loop such that a single turn of each winding extends fully around both the first radially inner and outer core portions without passing between them.

The radially inner magnetic core portion can be formed from a first material having a first core maximum permeability value, $M_{max}(1)$, and the radially outer core portion can be formed from a second material having a first core minimum permeability value, $M_{min}(1)$, less than the first core maximum permeability value, $M_{max}(1)$. A relationship between the first core maximum and minimum permeability values, $M_{max}(1)$ and $M_{min}(1)$, and the first inner and outer effective radii, $R_{in}(1)$ and $R_{out}(1)$, can be according to Equation 1.

$$0.90 \leq [M_{max}(1)/M_{min}(1)]*[(R_{in}(1)/R_{out}(1)] \leq 1.10 \quad (1)$$

In certain embodiments, the step of forming a first magnetic core section further includes disposing at least one first intermediate magnetic core portion annularly between the first inner and outer magnetic core portions, the at least one first intermediate magnetic core portion having a corresponding at least one first core intermediate permeability value, $M_i(1)$, between the first core maximum and minimum permeability values, $M_{max}(1)$ and $M_{min}(1)$ according to Equation 2, such that:

$$M_{max}(1) \leq M_i(1) \leq M_{min}(1) \quad (2)$$

The step of forming a first magnetic core section can further include disposing a plurality of first intermediate magnetic core portions annularly between the inner and outer magnetic core portions, each of the plurality of first intermediate magnetic core portions having a corresponding first core intermediate permeability value, $M_i(1)$, each first core intermediate permeability value, $M_i(1)$ having a stepwise difference from an adjacent first core intermediate permeability value, $M_i(1)$, such that the plurality of first core intermediate permeability values, $M_i(1)$, result in the first magnetic core section approaching a continuously variable permeability radially between the first inner and outer magnetic core portions.

The step of forming a first magnetic core section also can include annularly spacing the radially inner and outer magnetic core portions to form an air gap therebetween. In certain embodiments, the first and second core portions can be toroidal in shape, C-shaped, and/or E-shaped.

The method of making an inductor assembly can optionally include forming a second inductive loop having a second magnetic core section. A second wire can be wound into a plurality of conductive windings around the second magnetic core section such that a single turn of each winding extends fully around both the second radially inner and outer core portions without passing between them.

A second magnetic core section can be built and which includes at least a radially inner magnetic core portion with a second inner effective radius, $R_{in}(2)$, and a radially outer core portion with a second outer effective radius, $R_{out}(2)$. The radially inner magnetic core portion can be formed from a material having a second core maximum permeability value, $M_{max}(2)$, and the radially outer core portion can be formed from a material having a second core minimum permeability value, $M_{min}(2)$, less than the second core maximum permeability value, $M_{max}(2)$. A relationship between the second core maximum and minimum permeability values, $M_{max}(2)$ and $M_{min}(2)$, and the second inner and outer effective radii, $R_{in}(2)$ and $R_{out}(2)$, can be according to Equation 3.

$$0.90 \leq [M_{max}(2)/M_{min}(2)]*[(R_{in}(2)/R_{out}(2)] \leq 1.10 \quad (3)$$

DISCUSSION OF POSSIBLE EMBODIMENTS

The following are non-exclusive descriptions of possible embodiments of the present invention.

An embodiment of an inductor assembly includes at least a first inductive loop with a first wire formed into a plurality of conductive windings around a first magnetic core section. The first magnetic core section includes at least a radially inner magnetic core portion with a first inner effective radius, $R_{in}(1)$, and a radially outer magnetic core portion with a first outer effective radius, $R_{out}(1)$. The radially inner magnetic core portion is formed from a first material having a first core maximum permeability value, $M_{max}(1)$. The radially outer magnetic core portion is formed from a second material having a first core minimum permeability value, $M_{min}(1)$, less than the first core maximum permeability value, $M_{max}(1)$. A single turn of each winding extends fully around both the first radially inner and outer core portions without passing between them.

The inductor assembly of the preceding paragraph can optionally include, additionally and/or alternatively, any one or more of the following features, configurations and/or additional components:

An inductor assembly according to an exemplary embodiment of this disclosure, among other possible things includes a first inductive loop comprising: a first magnetic core section including at least a radially inner magnetic core portion with a first inner effective radius, $R_{in}(1)$, and a radially outer magnetic core portion with a first outer effective radius, $R_{out}(1)$, the radially inner magnetic core portion formed from a first material having a first core maximum permeability value, $M_{max}(1)$, and the radially outer magnetic core portion formed from a second material having a first core minimum permeability value, $M_{min}(1)$, less than the first core maximum permeability value, $M_{max}(1)$; and a first wire formed into a plurality of conductive windings around the first magnetic core section, a single turn of each winding extending fully around both the first radially inner and outer core portions without passing between them.

A further embodiment of the foregoing inductor assembly, wherein a relationship between the first core maximum and minimum permeability values, $M_{max}(1)$ and $M_{min}(1)$, and the first inner and outer effective radii, $R_{in}(1)$ and $R_{out}(1)$, is:

$$0.90 \leq [M_{max}(1)/M_{min}(1)]*[(R_{in}(1)/R_{out}(1)] \leq 1.10.$$

A further embodiment of any of the foregoing inductor assemblies, wherein the first magnetic core section also includes at least one first intermediate magnetic core portion disposed annularly between the first radially inner and outer magnetic core portions, the at least one first intermediate magnetic core portion having a corresponding at least one first core intermediate permeability value, $M_i(1)$, between first core maximum and minimum permeability values, $M_{max}(1)$ and $M_{min}(1)$, such that:

$$M_{max}(1) \leq M_i(1) \leq M_{min}(1).$$

A further embodiment of any of the foregoing inductor assemblies, wherein the first magnetic core section also includes a plurality of first intermediate magnetic core portions disposed annularly between the radially inner and outer magnetic core portions, each of the first intermediate magnetic core portions having a corresponding first core intermediate permeability value, $M_i(1)$, each first core intermediate permeability value, $M_i(1)$ having a stepwise difference from an adjacent first core intermediate permeability value, $M_i(1)$, such that the plurality of first core intermediate permeability values, $M_i(1)$, result in the first magnetic core section approaching continuously variable permeability between first radially inner and outer magnetic core portions.

A further embodiment of any of the foregoing inductor assemblies, wherein the first magnetic core section also includes an air gap disposed annularly between the radially inner and outer magnetic core portions.

A further embodiment of any of the foregoing inductor assemblies, further comprising: a second inductive loop comprising a second magnetic core section including at least a radially inner magnetic core portion with a second inner effective radius, $R_{in}(2)$, and a radially outer magnetic core portion with a second outer effective radius, $R_{out}(2)$, the radially inner magnetic core portion formed from a third material having a second core maximum permeability value, $M_{max}(2)$, and the radially outer magnetic core portion formed from a fourth material having a second core minimum permeability value, $M_{min}(2)$, less than the second core maximum permeability value, $M_{max}(2)$; and a second wire formed into a plurality of conductive windings around the second magnetic core section, a single turn of each winding extending fully around the second magnetic core section without passing between the radially inner and outer core portions; wherein a relationship between the second core maximum and minimum permeability values, $M_{max}(2)$ and $M_{min}(2)$, and the second inner and outer effective radii, $R_{in}(2)$ and $R_{out}(2)$, is:

$$0.90 \leq [M_{max}(2)/M_{min}(2)]*[(R_{in}(2)/R_{out}(2)] \leq 1.10.$$

A further embodiment of any of the foregoing inductor assemblies, wherein the first and second core portions are toroidal in shape.

A further embodiment of any of the foregoing inductor assemblies, wherein the first and second core portions are C-shaped.

A further embodiment of any of the foregoing inductor assemblies, wherein at least one of the first and second portions include at least one leg of an E-shaped core.

An embodiment of a method of making an inductor assembly includes building at least a first magnetic core section, and winding a first wire into a plurality of conductive windings to form a first inductive loop. The first magnetic core section includes at least a radially inner magnetic core portion with a first inner effective radius, $R_{in}(1)$, and a radially outer core portion with a first outer effective radius, $R_{out}(1)$. The radially inner magnetic core portion is formed from a first material having a first core maximum permeability value, $M_{max}(1)$, and the radially outer magnetic core portion is formed from a second material having a first core minimum permeability value, $M_{min}(1)$, less than the first core maximum permeability value, $M_{max}(1)$. A single turn of each winding extends fully around both the first radially inner and outer core portions without passing between them.

The method of the preceding paragraph can optionally include, additionally and/or alternatively, any one or more of the following features, configurations and/or additional components:

A method according to an exemplary embodiment of this disclosure, among other possible things includes building a first magnetic core section including at least a radially inner magnetic core portion with a first inner effective radius, $R_{in}(1)$, and a radially outer core portion with a first outer effective radius, $R_{out}(1)$, the radially inner magnetic core portion formed from a first material having a first core maximum permeability value, $M_{max}(1)$, and the radially outer core portion formed from a second material having a first core minimum permeability value, $M_{min}(1)$, less than the first core maximum permeability value, $M_{max}(1)$; and winding a first wire into a plurality of conductive windings to form a first inductive loop such that a single turn of each winding extends fully around both the first radially inner and outer core portions without passing between them.

A further embodiment of the foregoing method, wherein a relationship between the first core maximum and minimum permeability values, $M_{max}(1)$ and $M_{min}(1)$, and the first inner and outer effective radii, $R_{in}(1)$ and $R_{out}(1)$, is:

$$0.90 \leq [M_{max}(1)/M_{min}(1)]*[(R_{in}(1)/R_{out}(1)] \leq 1.10.$$

A further embodiment of any of the foregoing methods, wherein the step of forming a first magnetic core section further comprises: disposing at least one first intermediate magnetic core portion annularly between the first inner and outer magnetic core portions, the at least one first intermediate magnetic core portion having a corresponding at least one first core intermediate permeability value, $M_i(1)$, between the first core maximum and minimum permeability values, $M_{max}(1)$ and $M_{min}(1)$, such that:

$$M_{max}(1) \leq M_i(1) \leq M_{min}(1).$$

A further embodiment of any of the foregoing methods, wherein the step of forming a first magnetic core section further comprises: disposing a plurality of first intermediate magnetic core portions annularly between the inner and outer magnetic core portions, each of the plurality of first intermediate magnetic core portions having a corresponding first core intermediate permeability value, $M_i(1)$, each first core intermediate permeability value, $M_i(1)$ having a stepwise difference from an adjacent first core intermediate permeability value, $M_i(1)$, such that the plurality of first core intermediate permeability values, $M_i(1)$, result in the first magnetic core section approaching a continuously variable permeability radially between the first inner and outer magnetic core portions.

A further embodiment of any of the foregoing methods, wherein the step of forming a first magnetic core section also includes annularly spacing the radially inner and outer magnetic core portions to form an air gap therebetween.

A further embodiment of any of the foregoing methods, wherein the first and second core portions are toroidal in shape, C-shaped, or E-shaped.

A further embodiment of any of the foregoing methods, further comprising: building a second magnetic core section including at least a radially inner magnetic core portion with a second inner effective radius, $R_{in}(2)$, and a radially outer core portion with a second outer effective radius, $R_{out}(2)$, the radially inner magnetic core portion formed from a third material having a second core maximum permeability value, $M_{max}(2)$, and the radially outer core portion formed from a fourth material having a second core minimum permeability value, $M_{min}(2)$, less than the second core maximum permeability value, $M_{max}(2)$; and winding a second wire into a plurality of conductive windings to form a second inductive loop such that a single turn of each winding extends fully around both the second radially inner and outer core portions without passing between them.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An inductor assembly comprising:

a first inductive loop comprising:

a first magnetic core section including at least a first radially inner magnetic core portion with a first inner effective radius, $R_{in}(1)$, and a first radially outer magnetic core portion with a first outer effective radius, $R_{out}(1)$, the first radially inner magnetic core portion formed from a first material having a first core maximum permeability value, $M_{max}(1)$, and the first radially outer magnetic core portion formed from a second material having a first core minimum permeability value, $M_{min}(1)$, less than the first core maximum permeability value, $M_{max}(1)$; and a first wire formed into a plurality of conductive windings around an entirety of the first magnetic core section, a single turn of each winding extending fully around both the first radially inner and outer magnetic core portions without passing between them;

wherein the first material for the radially inner magnetic core portion and the second material for the radially outer magnetic core portion are selected to result in a ratio of the first core maximum permeability value $M_{max}(1)$ and the first core minimum permeability value, $M_{min}(1)$, being similar to a ratio between the first inner effective radius, $R_{in}(1)$ and the first outer effective radius, $R_{out}(1)$, such that the first magnetic core section has a substantially constant reluctance independent of radial position.

2. The inductor assembly of claim 1, wherein a relationship between the ratio of the first core maximum and minimum permeability values, $M_{max}(1)$ and $M_{min}(1)$, and the ratio of the first inner and outer effective radii, $R_{in}(1)$ and $R_{out}(1)$, is:

$$0.90 \leq [M_{max}(1)/M_{min}(1)]*[(R_{in}(1)/R_{out}(1)] \leq 1.10.$$

3. The inductor assembly of claim 1, wherein the first magnetic core section also includes at least one first intermediate magnetic core portion disposed annularly between the first radially inner and outer magnetic core portions, the at least one first intermediate magnetic core portion having a corresponding at least one first core intermediate permeability value, $M_i(1)$, between first core maximum and minimum permeability values, $M_{max}(1)$ and $M_{min}(1)$, such that:

$$M_{max}(1) \leq M_i(1) \leq M_{min}(1).$$

4. The inductor assembly of claim 3, wherein the first magnetic core section includes a plurality of first intermediate magnetic core portions disposed annularly between the first radially inner and outer magnetic core portions, each of the first intermediate magnetic core portions having a corresponding first core intermediate permeability value, $M_i(1)$, each first core intermediate permeability value, $M_i(1)$ having a stepwise difference from an adjacent first core intermediate permeability value, $M_i(1)$, such that the plurality of first core intermediate permeability values, $M_i(1)$, result in the first magnetic core section approaching a continuously variable permeability between the first radially inner and outer magnetic core portions.

5. The inductor assembly of claim 1, further comprising:

a second inductive loop comprising:

a second magnetic core section including at least a radially inner magnetic core portion with a second inner effective radius, $R_{in}(2)$, and a radially outer magnetic core portion with a second outer effective radius, $R_{out}(2)$, the radially inner magnetic core portion formed from a third material having a second core maximum permeability value, $M_{max}(2)$, and the radially outer magnetic core portion formed from a fourth material having a second core minimum permeability value, $M_{min}(2)$, less than the second core maximum permeability value, $M_{max}(2)$; and a second wire formed into a plurality of conductive windings around the second magnetic core section, a single turn of each winding extending fully around the second magnetic core section without passing between the radially inner and outer core portions;

wherein the third material for the radially inner magnetic core portion and the fourth material for the radially outer magnetic core portion are selected to result in a ratio of the second core maximum permeability value, $M_{max}(2)$ and the second core minimum permeability value, $M_{min}(2)$, being similar to a ratio between the second inner effective radius, $R_{in}(2)$ and the second outer effective radius, $R_{out}(2)$, such that the second magnetic core section has a substantially constant reluctance independent of radial position;

wherein a relationship between the second core maximum and minimum permeability values, $M_{max}(2)$ and $M_{min}(2)$, and the second inner and outer effective radii, $R_{in}(2)$ and $R_{out}(2)$, is:

$$0.90 \leq [M_{max}(2)/M_{min}(2)]*[(R_{in}(2)/R_{out}(2)] \leq 1.10.$$

6. The inductor assembly of claim 1, wherein the first radially inner and outer magnetic core portions are toroidal in shape.

7. The inductor assembly of claim 1, wherein the first radially inner and outer magnetic core portions are C-shaped.

8. The inductor assembly of claim 1, wherein at least one of the first radially inner and outer magnetic core portions include at least one leg of an E-shaped core.

9. The inductor assembly of claim 1, wherein the first magnetic core section also includes an air gap disposed annularly between the first radially inner and outer magnetic core portions.

10. A method of making an inductor assembly, the method comprising:

building a first magnetic core section including at least a first radially inner magnetic core portion with a first inner effective radius, $R_{in}(1)$, and a first radially outer core portion with a first outer effective radius, $R_{out}(1)$, the first radially inner magnetic core portion formed from a first material having a first core maximum permeability value, $M_{max}(1)$, and the first radially outer core portion formed from a second material having a first core minimum permeability value, $M_{min}(1)$, less than the first core maximum permeability value, $M_{max}(1)$; and winding a first wire into a plurality of conductive windings an entirety of the first magnetic core section to form a first inductive loop such that a single turn of each winding extends fully around both the first radially inner and outer magnetic core portions without passing between them;

wherein the first material for the radially inner magnetic core portion and the second material for the radially outer magnetic core portion are selected to result in a ratio of the first core maximum permeability value, $M_{max}(1)$ and the first core minimum permeability value, $M_{min}(1)$, being similar to a ratio between the first inner effective radius, $R_{in}(1)$ and the first outer effective radius, $R_{out}(1)$, such that the first magnetic core section has a substantially constant reluctance independent of radial position.

11. The method of claim 10, wherein a relationship between the ratio of the first core maximum and minimum permeability values, $M_{max}(1)$ and $M_{min}(1)$, and the ratio of the first inner and outer effective radii, $R_{in}(1)$ and $R_{out}(1)$, is:

$$0.90 \leq [M_{max}(1)/M_{min}(1)]*[(R_{in}(1)/R_{out}(1)] \leq 1.10.$$

12. The method of claim 10, wherein the step of forming a first magnetic core section further comprises:

disposing at least one first intermediate magnetic core portion annularly between the first radially inner and outer magnetic core portions, the at least one first intermediate magnetic core portion having a corresponding at least one first core intermediate permeability value, $M_i(1)$, between the first core maximum and minimum permeability values, $M_{max}(1)$ and $M_{min}(1)$, such that:

$$M_{max}(1) \leq M_i(1) \leq M_{min}(1).$$

13. The method of claim 12, wherein the step of forming a first magnetic core section further comprises:

disposing a plurality of first intermediate magnetic core portion annularly between the first radially inner and outer magnetic core portions, each of the plurality of first intermediate magnetic core portions having a corresponding first core intermediate permeability value, $M_i(1)$, each first core intermediate permeability value, $M_i(1)$ having a stepwise difference from an adjacent first core intermediate permeability value, $M_i(1)$, such that the plurality of first core intermediate permeability values, $M_i(1)$, result in the first magnetic core section approaching a continuously variable permeability radially between the first radially and outer magnetic core portions.

14. The method of claim 10, wherein the step of forming a first magnetic core section also includes annularly spacing the first radially inner and outer magnetic core portions to form an air gap therebetween.

15. The method of claim 10, wherein the first radially inner and outer magnetic core portions are toroidal in shape, C-shaped, or E-shaped.

16. The method of claim 10, further comprising:

building a second magnetic core section including at least a second radially inner magnetic core portion with a second inner effective radius, $R_{in}(2)$, and a second radially outer core portion with a second outer effective radius, $R_{out}(2)$, the second radially inner magnetic core portion formed from a third material having a second core maximum permeability value, $M_{max}(2)$, and the second radially outer core portion formed from a fourth material having a second core minimum permeability value, $M_{min}(2)$, less than the second core maximum permeability value, $M_{max}(2)$; and winding a second wire into a plurality of conductive windings to form a second inductive loop such that a single turn of each winding extends fully around both the second radially inner and outer magnetic core portions without passing between them;

wherein the third material for the second radially inner magnetic core portion and the fourth material for the second radially outer core portion are selected to result in a ratio of the second core maximum permeability value, $M_{max}(2)$ and the second core minimum permeability value, $M_{min}(2)$, being similar to a ratio between the second inner effective radius, $R_{in}(2)$ and the second outer effective radius, $R_{out}(2)$, such that the second magnetic core section has a substantially constant reluctance independent of radial position.

* * * * *